United States Patent [19]

Thomas

[11] 3,972,088

[45] Aug. 3, 1976

[54] ELECTRIC FLOOR SCRUBBER

[76] Inventor: Clarence Thomas, 403 W. 21st St. Apt. 4-W, New York, N.Y. 10011

[22] Filed: Oct. 8, 1974

[21] Appl. No.: 513,096

[52] U.S. Cl. ..... 15/4; 15/22 R; 15/93 R; 15/98

[51] Int. Cl.[2] ..... A47L 11/12

[58] Field of Search ..... 15/22 R, 22 A, 49 R, 15/97 R, 98, 4, 111; 51/170 TL, 170 MT

[56] References Cited

UNITED STATES PATENTS

| | | | |
|---|---|---|---|
| 409,052 | 8/1889 | Maloy | 51/170 TL |
| 923,271 | 6/1909 | Johnson | 15/111 UX |
| 2,113,694 | 4/1938 | Kehle | 15/22 A |
| 3,251,087 | 5/1966 | Platt, Jr. | 15/98 |
| 3,546,822 | 12/1970 | Hutchins | 51/170 MT |
| 3,655,444 | 4/1972 | Young | 15/98 |

FOREIGN PATENTS OR APPLICATIONS

| | | | |
|---|---|---|---|
| 753,003 | 7/1933 | France | 15/111 |
| 1,199,655 | 8/1965 | Germany | 15/170 TL |

*Primary Examiner*—Edward L. Roberts

[57] ABSTRACT

An electric floor scrubber and buffer having its scrubber or buffer pad attached to the underside of an oscillating plate. A motor drive is provided for oscillating the plate which is disposed between flexible spacers extending between the plate and a stationary plate. The spacers serve to enhance the action of the oscillator plate and its underpad in performing their buffing or scrubbing functions.

1 Claim, 5 Drawing Figures

ELECTRIC FLOOR SCRUBBER

The invention relates to floor scrubbers and, in particular, to automatic scrubbers in which the scrubbing action is performed mechanically in a rotary or oscillating fashion.

According to the present invention there is provided an automatic floor scrubber in which enhanced freedom of movement is afforded the scrubbing components due to the use of flexible connecting elements secured to the housing structure and the operative components therein. Connectors of this sort have been previously known, e.g. U.S. Pat. No. 1,681,648, but have certain limitations in practice. The connectors in the present case are so arranged with respect to the moving and stationary parts of the device as to provide space for the driving elements thereof and at the same time increase its operational efficiency.

One object of the invention is to provide an automatic floor scrubber of improved design.

Other objects and advantages of the invention may be appreciated on reading the following description of one embodiment thereof which is taken together with the accompanying drawings, in which.

Figure 1:
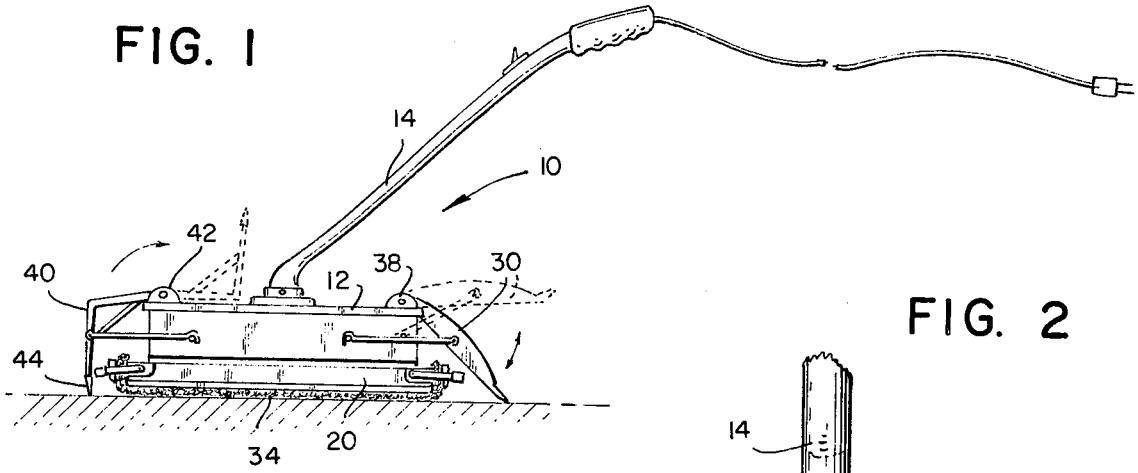
FIG. 1 is a side elevation of the scrubber.
Figure 2:
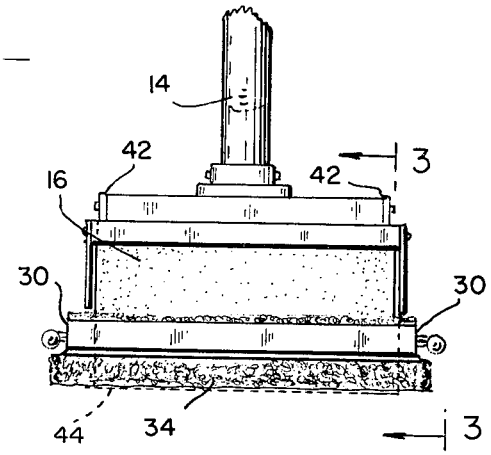
FIG. 2 is a front view of same.
Figure 5:
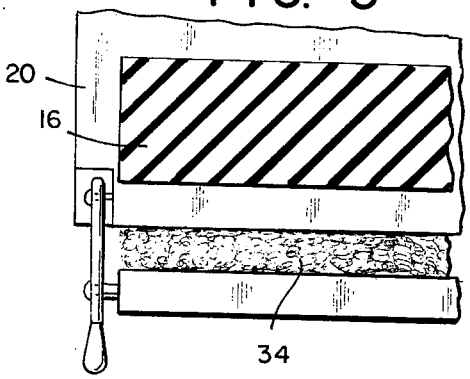
FIG. 5 is a partial section taken on the line 5—5 of FIG. 3.

Referring to the drawings the scrubber 10 has a top, stationary plate 12 to which is centrally secured a handle 14. Cemented to the underside of the plate 12 at one end is a flexible spacer 16 and at the other end a spacer 18. The spacers may be fabricated of hard foam rubber. At their bottom ends there is attached an oscillator plate 20 on the underside of which is provided a rubberized protective pad 46.

Disposed between the spacers and attached to the top plate 12 is motor 22 having a flywheel 24 mounted on its armature shaft. Arm 26 is swingably mounted at one end near the periphery of the flywheel, its other end being connected to the oscillator plate 20 by ball joint connection 28.

Pivotal clamp 30 at one end of the plate 20 and pivotal clamp 32 at the other end are provided to secure a pad of steel wool 34 snugly to the underside of the protective pad 46 underneath the plate 20. The steel wool may be replaced by a buffer pad as desired.

Figure 3:
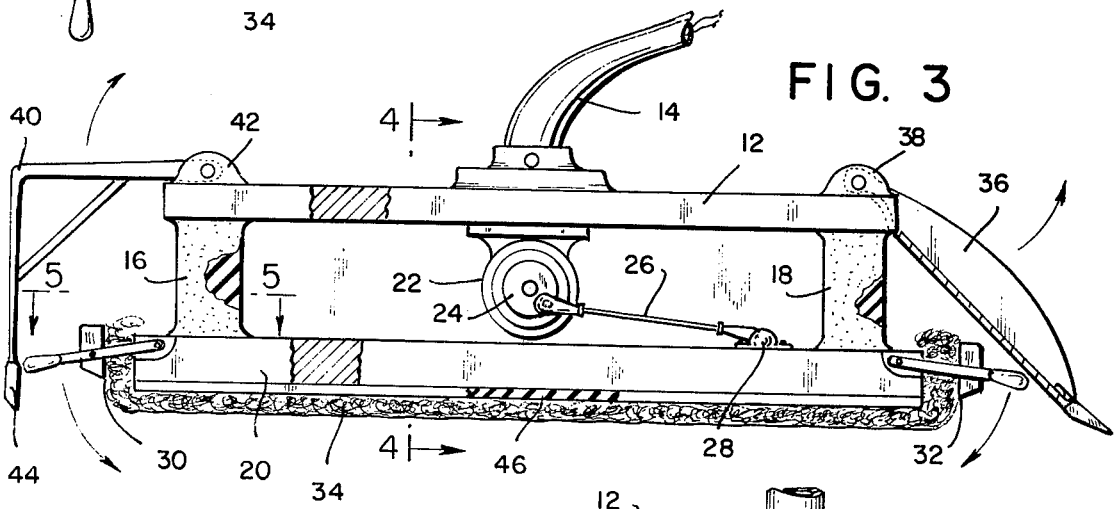
FIG. 3 is a section taken on line 3—3 of FIG. 2.
Figure 4:
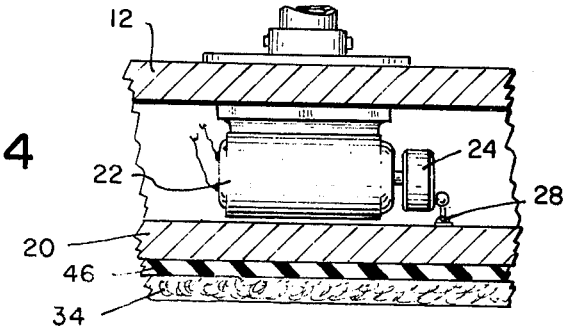
FIG. 4 is a partial section taken on the line 4—4 of FIG. 3.

A scraper 36 for removing chewing gum from the floor is pivotally mounted to bracket 38 atop the stationary plate 12 at one end thereof. As shown in FIG. 3, the scraper is disposed closely adjacent clamp 32 on the oscillator plate and is successively engaged thereby so as to cause the scraper to vibrate during operation of the machine. Similarly a squeegee arm 40 is pivotally mounted on the plate 12 by means of bracket 42 on the plate 12 at its other end. The arm 40 is provided with a tapered rubber tip 44 on its free end which is used to scrape away water or other cleansing fluid used in the floor cleaning.

In operation the oscillations of the plate 20 are aided by the flexing of the spacers which are used solely to connect the two plates together. The spacers also furnish some vertical resiliance to afford additional freedom of movement for removing adhering floor particles and minimizing the risk of tearing the cleaning pad when encountering such matter.

Various modification of the invention may be effected by persons skilled in the art without departing from the scope and principle of the invention as defined in the appended claims.

What is claimed is:

1. An electric floor scrubber comprising a stationary plate, an oscillator plate, flexible spacers connecting said plates, a cleaning pad attached to the underside of said oscillator plate, a pivotal clamp at each end of the scrubber for clamping said pad in position, a motor and shaft depending from said stationary plate, a crank arm connected at right angles to and eccentrically of said shaft and universally connected to said oscillator plate, the latter being thereby oscillated linearly, and a scraper pivotally mounted on the stationary plate and adapted to be engaged and linearly vibrated by one of said clamps due to the periodic movement of said oscillator plate.

* * * * *